US011075460B2

(12) United States Patent
Yu

(10) Patent No.: US 11,075,460 B2
(45) Date of Patent: Jul. 27, 2021

(54) ANTENNA STRUCTURE

(71) Applicant: Wistron Corp., New Taipei (TW)

(72) Inventor: Chung Ta Yu, New Taipei (TW)

(73) Assignee: WISTRON CORP., New Taipei (TW)

( * ) Notice: Subject to any disclaimer, the term of this patent is extended or adjusted under 35 U.S.C. 154(b) by 5 days.

(21) Appl. No.: 16/751,264

(22) Filed: Jan. 24, 2020

(65) Prior Publication Data

US 2021/0167504 A1 Jun. 3, 2021

(30) Foreign Application Priority Data

Nov. 29, 2019 (TW) ..... 108143540

(51) Int. Cl.

| | |
|---|---|
| ***H01Q 13/16*** | (2006.01) |
| ***H01Q 9/04*** | (2006.01) |
| ***H01Q 1/48*** | (2006.01) |
| ***H01Q 1/38*** | (2006.01) |

(52) U.S. Cl.

CPC ..... *H01Q 9/045* (2013.01); *H01Q 1/38* (2013.01); *H01Q 1/48* (2013.01); *H01Q 13/16* (2013.01)

(58) Field of Classification Search

CPC . H01Q 1/38–1/48; H01Q 13/10–13/16; H01Q 1/243; H01Q 9/04

See application file for complete search history.

(56) References Cited

U.S. PATENT DOCUMENTS

| | | | | |
|---|---|---|---|---|
| 6,507,322 | B2 * | 1/2003 | Fang | H01Q 21/24 343/702 |
| 7,079,079 | B2 * | 7/2006 | Jo | H01Q 1/243 343/700 MS |
| 7,161,543 | B2 * | 1/2007 | Cheng | G06F 1/1616 343/702 |
| 2013/0241792 | A1 * | 9/2013 | Ishikawa | H01Q 1/38 343/848 |
| 2020/0058992 | A1 * | 2/2020 | Wu | H01Q 21/28 |
| 2020/0235495 | A1 * | 7/2020 | Yang | H01Q 9/285 |

OTHER PUBLICATIONS

Chinese language office action dated Sep. 16, 2020, issued in application No. TW 108143540.

* cited by examiner

*Primary Examiner* — Hasan Islam
(74) *Attorney, Agent, or Firm* — McClure, Qualey & Rodack, LLP

(57) ABSTRACT

An antenna structure includes a nonconductive supporting element, a first feeding radiation element, a first grounding radiation element, a second feeding radiation element, and a second grounding radiation element. The first feeding radiation element and the second feeding radiation element are coupled to a signal source. The first feeding radiation element has a first slot. The second feeding radiation element has a second slot. The first grounding radiation element and the second grounding radiation element are coupled to a ground voltage. The first grounding radiation element is adjacent to the first feeding radiation element. The second grounding radiation element is adjacent to the second feeding radiation element. The first feeding radiation element, the first grounding radiation element, the second feeding radiation element, and the second grounding radiation element are disposed on the nonconductive supporting element.

18 Claims, 4 Drawing Sheets

ANTENNA STRUCTURE

CROSS REFERENCE TO RELATED APPLICATIONS

This Application claims priority of Taiwan Patent Application No. 108143540 filed on Nov. 29, 2019, the entirety of which is incorporated by reference herein.

BACKGROUND OF THE INVENTION

Field of the Invention

The disclosure generally relates to an antenna structure, and more particularly, to a wideband antenna structure.

Description of the Related Art

With the advancements being made in mobile communication technology, mobile devices such as portable computers, mobile phones, multimedia players, and other hybrid functional portable electronic devices are becoming more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a wideband antenna element that is small in size.

BRIEF SUMMARY OF THE INVENTION

In an exemplary embodiment, the invention is directed to an antenna structure that includes a nonconductive supporting element, a first feeding radiation element, a first grounding radiation element, a second feeding radiation element, and a second grounding radiation element. The first feeding radiation element is coupled to a signal source. The first feeding radiation element has a first slot. The first grounding radiation element is coupled to a ground voltage. The first grounding radiation element is adjacent to the first feeding radiation element. The second feeding radiation element is coupled to the signal source. The second feeding radiation element has a second slot. The second grounding radiation element is coupled to the ground voltage. The second grounding radiation element is adjacent to the second feeding radiation element. The first feeding radiation element, the first grounding radiation element, the second feeding radiation element, and the second grounding radiation element are disposed on the nonconductive supporting element.

In some embodiments, the nonconductive supporting element is a planar dielectric substrate.

In some embodiments, the nonconductive supporting element is a 3D (Three Dimensional) structure with a first surface and a second surface which are substantially perpendicular to each other.

In some embodiments, the first feeding radiation element and the first grounding radiation element are disposed on the first surface of the nonconductive supporting element.

In some embodiments, the second feeding radiation element and the second grounding radiation element are disposed on the second surface of the nonconductive supporting element.

In some embodiments, the first feeding radiation element substantially has an inverted L-shape.

In some embodiments, the first feeding radiation element includes a first narrow portion and a first wide portion coupled to each other.

In some embodiments, the first slot is formed in the first wide portion of the first feeding radiation element.

In some embodiments, the first grounding radiation element substantially has a J-shape.

In some embodiments, the first slot substantially has a rectangular shape.

In some embodiments, the second feeding radiation element substantially has an L-shape.

In some embodiments, the second feeding radiation element includes a second narrow portion and a second wide portion coupled to each other.

In some embodiments, the second slot is formed in the second wide portion of the second feeding radiation element.

In some embodiments, the second grounding radiation element substantially has an inverted J-shape.

In some embodiments, the second slot substantially has a rectangular shape.

In some embodiments, the antenna structure covers a first frequency band and a second frequency band. The first frequency band is from 2400 MHz to 2500 MHz. The second frequency band is from 5150 MHz to 5850 MHz.

In some embodiments, the length of the first feeding radiation element is substantially equal to 0.25 wavelength of the second frequency band.

In some embodiments, the length of the first grounding radiation element is substantially equal to 0.25 wavelength of the first frequency band.

In some embodiments, the length of the second feeding radiation element is substantially equal to 0.25 wavelength of the second frequency band.

In some embodiments, the length of the second grounding radiation element is substantially equal to 0.25 wavelength of the first frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
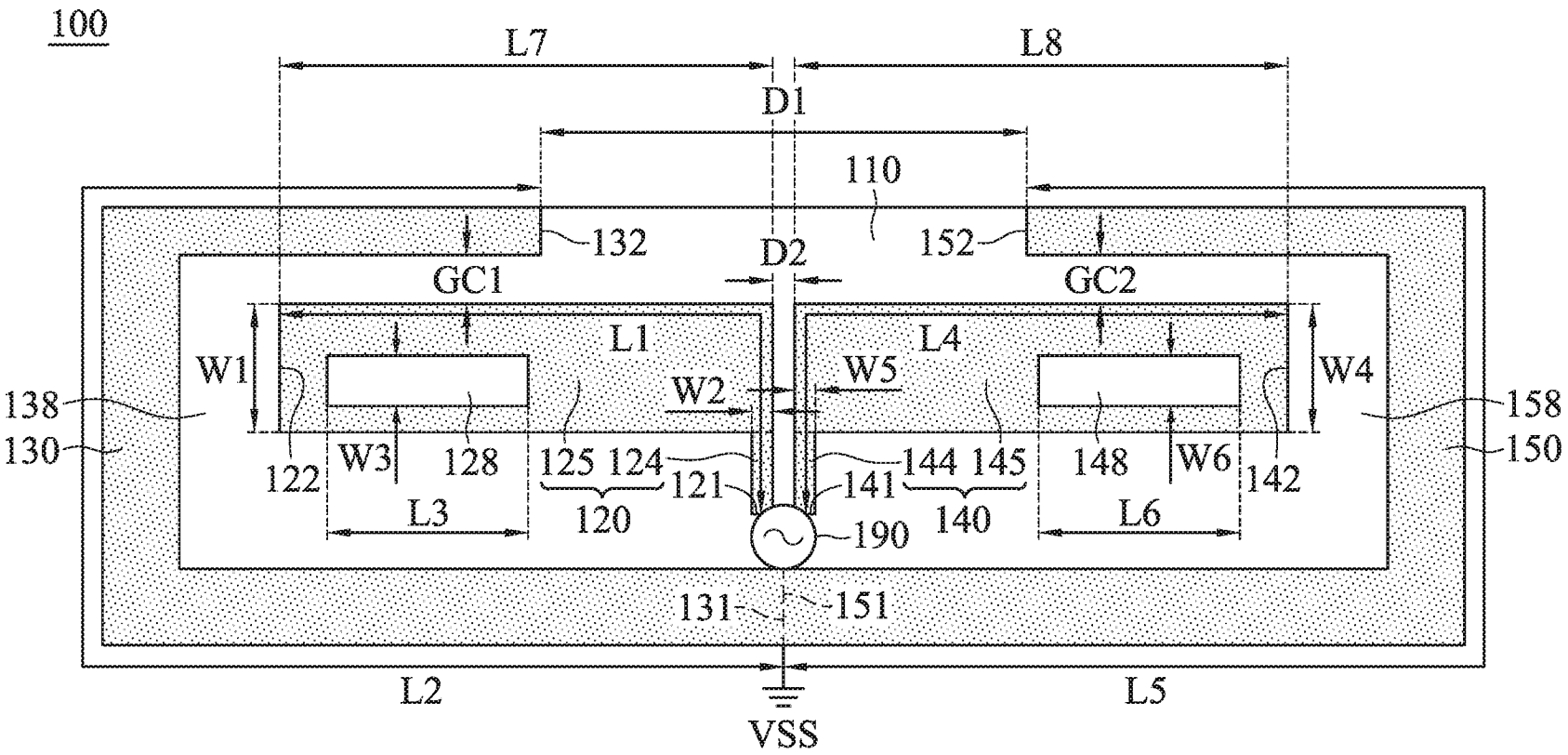
FIG. 1 is a top view of an antenna structure according to an embodiment of the invention.

In order to illustrate the foregoing and other purposes, features and advantages of the invention, the embodiments and figures of the invention are described in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a top view of an antenna structure 100 according to an embodiment of the invention. The antenna structure 100 may be applied to a mobile device, such as a smartphone, a tablet computer, or a notebook computer. In the embodiment of FIG. 1, the antenna structure 100 includes a nonconductive supporting element 110, a first feeding radiation element 120, a first grounding radiation element 130, a second feeding radiation element 140, and a second grounding radiation element 150. The first feeding radiation element 120, the first grounding radiation element 130, the second feeding radiation element 140, and the second grounding radiation element 150 may all be made of a metal material, such as copper, silver, aluminum, iron, or an alloy thereof. In some embodiments, the nonconductive supporting element 110 is a planar dielectric substrate, such as an FR4 (Flame Retardant 4) substrate, a PCB (Printed Circuit Board), or an FCB (Flexible Circuit Board). The first feeding radiation element 120, the first grounding radiation element 130, the second feeding radiation element 140, and the second grounding radiation element 150 may all be disposed on the same surface of the nonconductive supporting element 110.

The first feeding radiation element 120 may substantially have an inverted L-shape. Specifically, the first feeding radiation element 120 has a first end 121 and a second end 122. The first end 121 of the first feeding radiation element 120 is coupled to a signal source 190. The second end 122 of the first feeding radiation element 120 is an open end. For example, the signal source 190 may be an RF (Radio Frequency) module for exciting the antenna structure 100. In some embodiments, the first feeding radiation element 120 includes a first narrow portion 124 and a first wide portion 125 which are coupled to each other. The first narrow portion 124 is adjacent to the first end 121 of the first feeding radiation element 120. The first wide portion 125 is adjacent to the second end 122 of the first feeding radiation element 120. It should be noted that the term "adjacent" or "close" over the disclosure means that the distance (spacing) between two corresponding elements is smaller than a predetermined distance (e.g., 5 mm or the shorter), or means that the two corresponding elements directly touch each other (i.e., the aforementioned distance/spacing therebetween is reduced to 0). In the first feeding radiation element 120, the first wide portion 125 is substantially perpendicular to the first narrow portion 124. Furthermore, a first slot 128 is formed in the first wide portion 125 of the first feeding radiation element 120. The first slot 128 may substantially have a rectangular shape or a straight-line shape. The design of the first slot 128 can increase different resonant current paths on the first feeding radiation element 120.

The first grounding radiation element 130 may substantially have a J-shape. Specifically, the first grounding radiation element 130 has a first end 131 and a second end 132. The first end 131 of the first grounding radiation element 130 is coupled to a ground voltage VSS. The second end 132 of the first grounding radiation element 130 is an open end. For example, the ground voltage VSS may be provided by a system ground plane (not shown) of the antenna structure 100. The second end 132 of the first grounding radiation element 130 and the second end 122 of the first feeding radiation element 120 may extend in opposite directions. In some embodiments, the first grounding radiation element 130 defines a first notch region 138, and the second end 122 of the first feeding radiation element 120 extends into the first notch region 138. In addition, the second end 132 of the first grounding radiation element 130 is adjacent to the first wide portion 125 of the first feeding radiation element 120, such that a first coupling gap GC1 is formed between the first grounding radiation element 130 and the first feeding radiation element 120.

The second feeding radiation element 140 may substantially have an L-shape. Specifically, the second feeding radiation element 140 has a first end 141 and a second end 142. The first end 141 of the second feeding radiation element 140 is coupled to the signal source 190. The second end 142 of the second feeding radiation element 140 is an open end. In some embodiments, the second feeding radiation element 140 includes a second narrow portion 144 and a second wide portion 145 which are coupled to each other. The second narrow portion 144 is adjacent to the first end 141 of the second feeding radiation element 140. The second wide portion 145 is adjacent to the second end 142 of the second feeding radiation element 140. In the second feeding radiation element 140, the second wide portion 145 is substantially perpendicular to the second narrow portion 144. Furthermore, a second slot 148 is formed in the second wide portion 145 of the second feeding radiation element 140. The second slot 148 may substantially have a rectangular shape or a straight-line shape. The design of the second slot 148 can increase different resonant current paths on the second feeding radiation element 140.

The second grounding radiation element 150 may substantially have an inverted J-shape. Specifically, the second grounding radiation element 150 has a first end 151 and a second end 152. The first end 151 of the second grounding radiation element 150 is coupled to the ground voltage VSS. The second end 152 of the second grounding radiation element 150 is an open end. The second end 152 of the second grounding radiation element 150 and the second end 142 of the second feeding radiation element 140 may extend in opposite directions. The second end 152 of the second grounding radiation element 150 and the second end 132 of the first grounding radiation element 130 may extend toward each other. In some embodiments, the second grounding radiation element 150 defines a second notch region 158, and the second end 142 of the second feeding radiation element 140 extends into the second notch region 158. In addition, the second end 152 of the second grounding radiation element 150 is adjacent to the second wide portion 145 of the second feeding radiation element 140, such that a second coupling gap GC2 is formed between the second grounding radiation element 150 and the second feeding radiation element 140.

Generally, the antenna structure 100 can be a symmetrical structure with respect to its central line. For example, the second feeding radiation element 140 may be a mirror image of the first feeding radiation element 120, and the second grounding radiation element 150 may be a mirror image of the first grounding radiation element 130, but they are not limited thereto.

Figure 2:
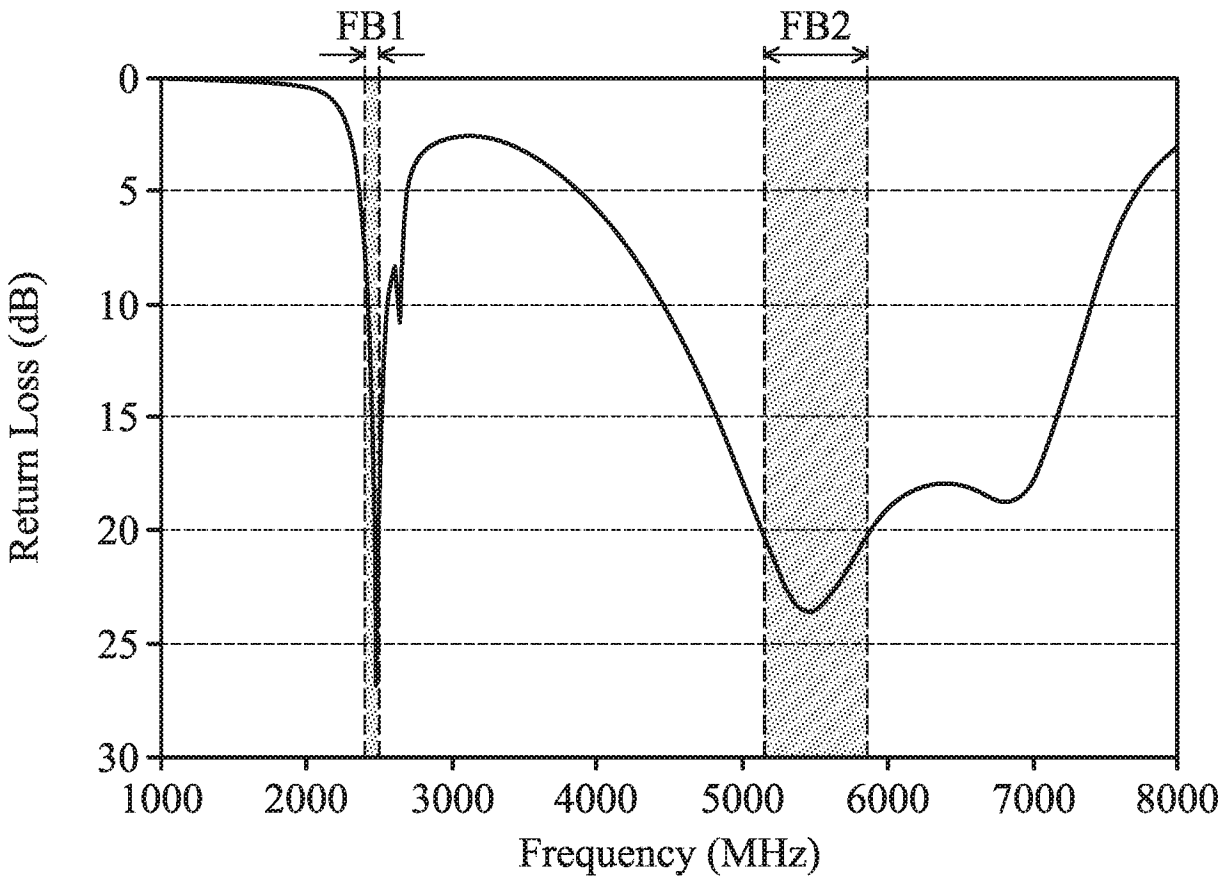
FIG. 2 is a diagram of return loss of an antenna structure according to an embodiment of the invention.

FIG. 2 is a diagram of return loss of the antenna structure 100 according to an embodiment of the invention. The horizontal axis represents the operation frequency (MHz), and the vertical axis represents the return loss (dB). According to the measurement of FIG. 2, the antenna structure 100 can cover a first frequency band FB1 and a second frequency band FB2. The first frequency band FB1 may be from 2400 MHz to 2500 MHz. The second frequency band FB2 may be from 5150 MHz to 5850 MHz. Accordingly, the antenna structure 100 can at least support the wideband operation of WLAN (Wireless Local Area Networks) 2.4 GHz/5 GHz. In alternative embodiments, the second frequency band FB2 further includes another frequency interval from 5850 MHz to 7500 MHz, and thus the antenna structure 100 can be applied to the sub-6 GHz wideband operation of next-generation 5G communication systems.

In some embodiments, the operation principles of the antenna structure 100 are described as follows. The first grounding radiation element 130 is excited by the first feeding radiation element 120 using a coupling mechanism, so as to generate the first frequency band FB1. The first feeding radiation element 120 is excited independently, so as to generate the second frequency band FB2. Furthermore, the second grounding radiation element 150 is excited by the second feeding radiation element 140 using a coupling mechanism, so as to generate the first frequency band FB1. The second feeding radiation element 140 is excited independently, so as to generate the second frequency band FB2. According to practical measurements, the design of the first slot 128 and the second slot 148 can fine-tune the impedance matching of the first frequency band FB1, thereby increasing the operation bandwidth of the first frequency band FB1. It should be noted that since the first feeding radiation element 120 and the second feeding radiation element 140 share the single signal source 190, the antenna structure 100 is implemented with a single cable, and it can reduce the total manufacturing cost of the antenna structure 100.

In some embodiments, the element sizes of the antenna structure 100 are described as follows. The length L1 of the first feeding radiation element 120 may be substantially equal to 0.25 wavelength (λ/4) of the second frequency band FB2 of the antenna structure 100. The length L2 of the first grounding radiation element 130 may be substantially equal to 0.25 wavelength (λ/4) of the first frequency band FB1 of the antenna structure 100. The length L3 of the first slot 128 may be shorter than or equal to a half of the length L7 of the first wide portion 125. The width W1 of the first wide portion 125 may be from 3 mm to 4 mm. The width W2 of the first narrow portion 124 may be from 0.5 mm to 1 mm. The width W3 of the first slot 128 may be from 1 mm to 1.5 mm. The width of the first coupling gap GC1 may be shorter than or equal to 2 mm. The length L4 of the second feeding radiation element 140 may be substantially equal to 0.25 wavelength (λ/4) of the second frequency band FB2 of the antenna structure 100. The length L5 of the second grounding radiation element 150 may be substantially equal to 0.25 wavelength (λ/4) of the first frequency band FB1 of the antenna structure 100. The length L6 of the second slot 148 may be shorter than or equal to a half of the length L8 of the second wide portion 145. The width W4 of the second wide portion 145 may be from 3 mm to 4 mm. The width W5 of the second narrow portion 144 may be from 0.5 mm to 1 mm. The width W6 of the second slot 148 may be from 1 mm to 1.5 mm. The width of the second coupling gap GC2 may be shorter than or equal to 2 mm. The distance D1 between the second end 152 of the second grounding radiation element 150 and the second end 132 of the first grounding radiation element 130 may be from 9 mm to 10 mm. The distance D2 between the first feeding radiation element 120 and the second feeding radiation element 140 may be from 0.5 mm to 1 mm. The above ranges of element sizes are calculated and obtained according to many experiment results, and they help to optimize the operation bandwidth and impedance matching of the antenna structure 100.

Figure 3:
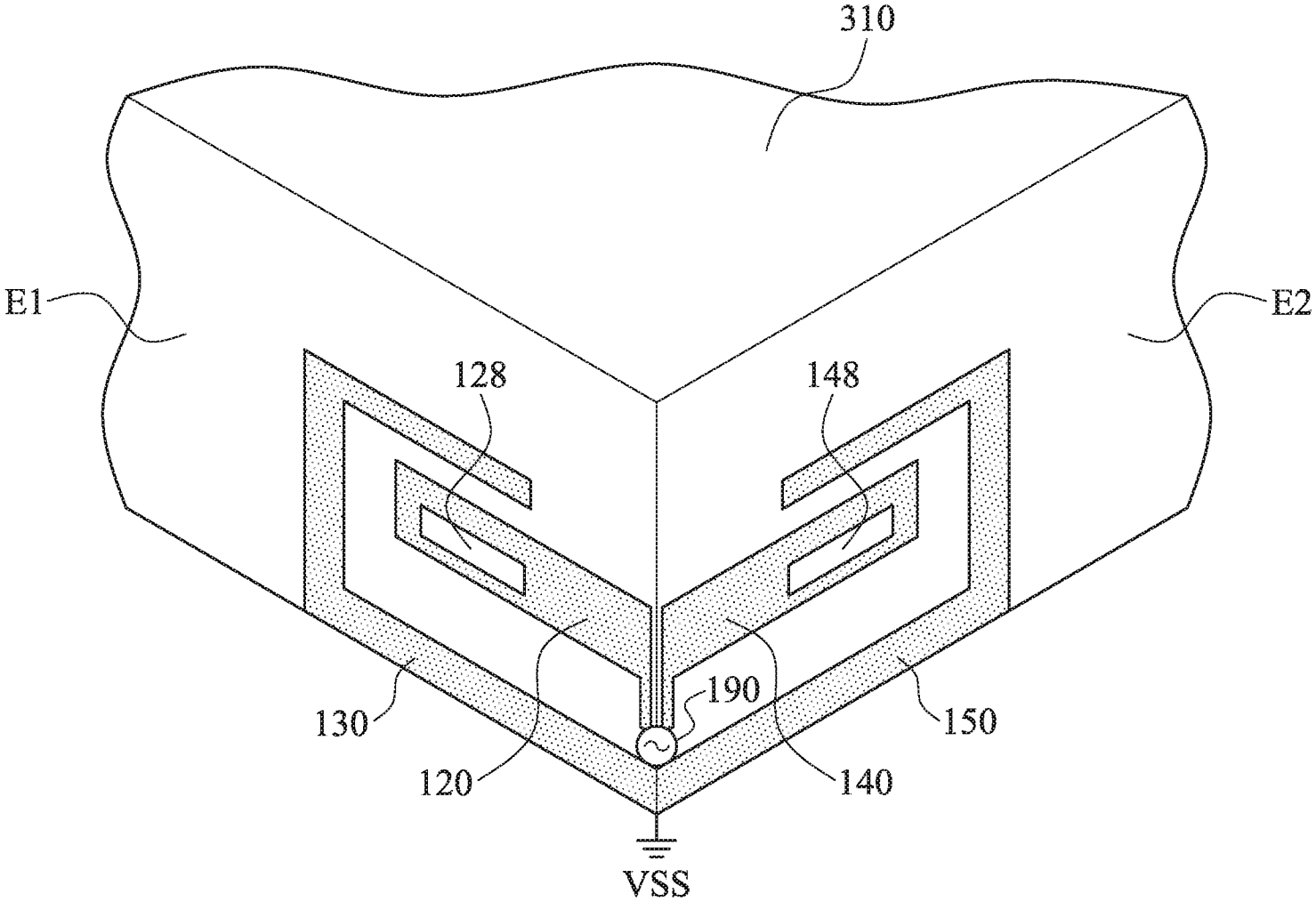
FIG. 3 is a perspective view of an antenna structure according to another embodiment of the invention.

FIG. 3 is a perspective view of an antenna structure 300 according to another embodiment of the invention. FIG. 3 is similar to FIG. 1. In the embodiment of FIG. 3, a nonconductive supporting element 310 of the antenna structure 300 is a 3D (Three Dimensional) structure with a first surface E1 and a second surface E2 which are substantially perpendicular to each other. The first feeding radiation element 120 and the first grounding radiation element 130 are both disposed on the first surface E1 of the nonconductive supporting element 310. The second feeding radiation element 140 and the second grounding radiation element 150 are both disposed on the second surface E2 of the nonconductive supporting element 310. According to practical measurements, such a design not only increases the antenna design flexibility but also enlarges the beam width of the radiation pattern of the antenna structure 300. Other features of the antenna structure 300 of FIG. 3 are similar to those of the antenna structure 100 of FIG. 1. Therefore, the two embodiments can achieve similar levels of performance.

For another embodiment of the invention, the first surface E1 and the second surface E2 of the nonconductive supporting element 310 are not coplanar and not perpendicular to each other in response communication products' corners with non-right angles (e.g., arc-shaped designs), thereby fitting the mechanism designs of corners of notebook computers (e.g., the first surface E1 and the second surface E2 may be attached to an arc-shaped surface). The first feeding radiation element 120 and the first grounding radiation element 130 are both disposed on the first surface E1 of the nonconductive supporting element 310. The second feeding radiation element 140 and the second grounding radiation element 150 are both disposed on the second surface E2 of the nonconductive supporting element 310.

Figure 4:
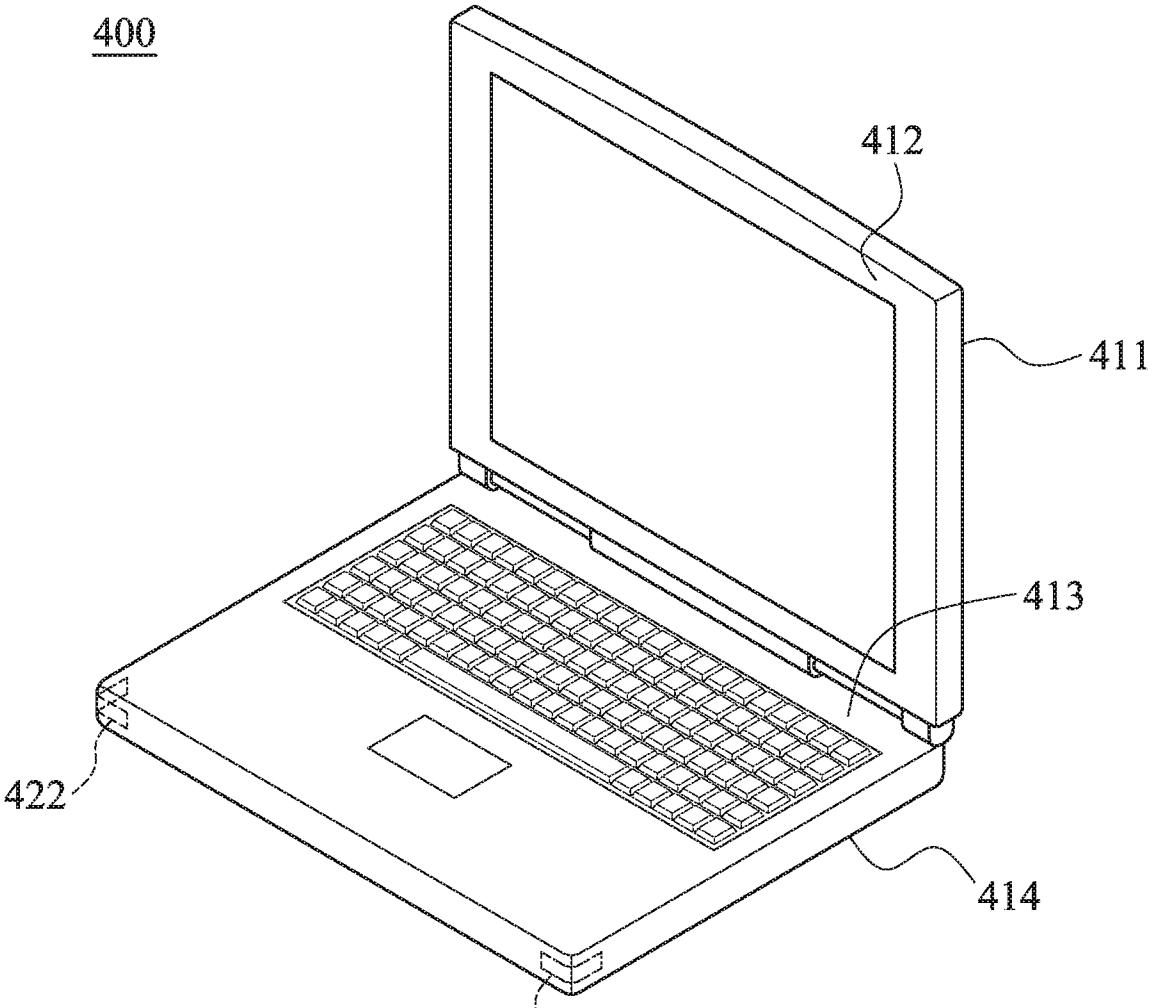
FIG. 4 is a diagram of a notebook computer according to an embodiment of the invention.

FIG. 4 is a diagram of a notebook computer 400 according to an embodiment of the invention. In the embodiment of FIG. 4, the aforementioned antenna structure 300 can be applied to the notebook computer 400. The notebook computer 400 includes an upper cover housing 411, a display frame 412, a keyboard frame 413, and a base housing 414.

It should be understood that the upper cover housing 411, the display frame 412, the keyboard frame 413, and the base housing 414 are equivalent to the so-called "A-component", "B-component", "C-component", and "D-component" in the field of notebook computers. The antenna structure 300 may be positioned at a first corner 421 or a second corner 422 between the keyboard frame 413 and the base housing 414. For example, the antenna structure 300 may be produced with LDS (Laser Direct Structuring) technology, but it is not limited thereto. It should be noted that such a design can minimize the total size of the antenna structure 300, and effectively use the limited internal space of the notebook computer 400.

The invention proposes a novel antenna structure. In comparison to the conventional antenna design, it has at least the advantages of small size, wide bandwidth, single feed, and low manufacturing cost. Therefore, the antenna structure of the invention is suitable for application in a variety of current small-size mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-4. The invention may include any one or more features of any one or more embodiments of FIGS. 1-4. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a first feeding radiation element, coupled to a signal source, wherein the first feeding radiation element has a first slot;

a first grounding radiation element, coupled to a ground voltage, wherein the first grounding radiation element is adjacent to the first feeding radiation element;

a second feeding radiation element, coupled to the signal source, wherein the second feeding radiation element has a second slot;

a second grounding radiation element, coupled to the ground voltage, wherein the second grounding radiation element is adjacent to the second feeding radiation element; and a nonconductive supporting element, wherein the first feeding radiation element, the first grounding radiation element, the second feeding radiation element, and the second grounding radiation element are disposed on the nonconductive supporting element;

wherein both of the first slot and the second slot are enclosed slots;

wherein the nonconductive supporting element is a 3D (Three Dimensional) structure with a first surface and a second surface which are perpendicular to each other;

wherein the second feeding radiation element and the second grounding radiation element are disposed on the second surface of the nonconductive supporting element.

2. The antenna structure as claimed in claim 1, wherein the nonconductive supporting element is a planar dielectric substrate.

3. The antenna structure as claimed in claim 1, wherein the first feeding radiation element and the first grounding radiation element are disposed on the first surface of the nonconductive supporting element.

4. The antenna structure as claimed in claim 1, wherein the first feeding radiation element has an inverted L-shape.

5. The antenna structure as claimed in claim 1, wherein the first feeding radiation element comprises a first narrow portion and a first wide portion coupled to each other.

6. The antenna structure as claimed in claim 5, wherein the first slot is formed in the first wide portion of the first feeding radiation element.

7. The antenna structure as claimed in claim 1, wherein the first grounding radiation element has a J-shape.

8. The antenna structure as claimed in claim 1, wherein the first slot has a rectangular shape.

9. The antenna structure as claimed in claim 1, wherein the second feeding radiation element has an L-shape.

10. The antenna structure as claimed in claim 1, wherein the second feeding radiation element comprises a second narrow portion and a second wide portion coupled to each other.

11. The antenna structure as claimed in claim 10, wherein the second slot is formed in the second wide portion of the second feeding radiation element.

12. The antenna structure as claimed in claim 1, wherein the second grounding radiation element has an inverted J-shape.

13. The antenna structure as claimed in claim 1, wherein the second slot has a rectangular shape.

14. The antenna structure as claimed in claim 1, wherein the antenna structure covers a first frequency band and a second frequency band, the first frequency band is from 2400 MHz to 2500 MHz, and the second frequency band is from 5150 MHz to 5850 MHz.

15. The antenna structure as claimed in claim 14, wherein a length of the first feeding radiation element is equal to 0.25 wavelength of the second frequency band.

16. The antenna structure as claimed in claim 14, wherein a length of the first grounding radiation element is equal to 0.25 wavelength of the first frequency band.

17. The antenna structure as claimed in claim 14, wherein a length of the second feeding radiation element is equal to 0.25 wavelength of the second frequency band.

18. The antenna structure as claimed in claim 14, wherein a length of the second grounding radiation element is equal to 0.25 wavelength of the first frequency band.

* * * * *